United States Patent [19]

Khandros

[11] 4,357,394

[45] Nov. 2, 1982

[54] CENTRIFUGAL CASTING

[75] Inventor: Igor Y. Khandros, Hoboken, N.J.

[73] Assignee: Abex Corporation, New York, N.Y.

[21] Appl. No.: 291,027

[22] Filed: Aug. 7, 1981

Related U.S. Application Data

[62] Division of Ser. No. 168,728, Jul. 14, 1980, abandoned.

[51] Int. Cl.[3] ..... B22D 19/16; B32B 15/18; B32B 15/20

[52] U.S. Cl. ..... 428/595; 428/610; 428/652; 428/653

[58] Field of Search ..... 164/96, 95, 114, 66, 164/66.1; 428/653, 610, 595, 586, 652

[56] References Cited

U.S. PATENT DOCUMENTS

| | | | |
|---|---|---|---|
| 1,514,129 | 11/1924 | Clark | 164/95 |
| 1,831,310 | 11/1931 | Lindemuth | 164/96 X |
| 1,958,109 | 5/1934 | Morris | 164/95 X |
| 2,087,347 | 7/1937 | Larsen | 164/66 |
| 2,745,152 | 5/1956 | Johnson | 164/114 |
| 4,077,801 | 3/1978 | Heyer et al. | 75/122 |

FOREIGN PATENT DOCUMENTS

| | | | |
|---|---|---|---|
| 47-22329 | 10/1972 | Japan | 164/96 |
| 52-70935 | 6/1977 | Japan | 164/66 |
| 54-149012 | 11/1979 | Japan | 164/114 |
| 55-50961 | 4/1980 | Japan | 164/66 |

*Primary Examiner*—Gus T. Hampilos
*Assistant Examiner*—J. Reed Batten, Jr.
*Attorney, Agent, or Firm*—Kinzer, Plyer, Dorn & McEachran

[57] ABSTRACT

A centrifugal casting of tubular form exhibiting an outer layer of a heavy (high density) metal having a high melting point, an inner layer of a lighter (low density) lower melting point metal and an intermediate zone where the two metals vary continuously and oppositely as to concentration from the inner layer to the outer layer; in the case of a tube these layers are the inner diameter (I.D.) and the outer diameter (O.D.).

6 Claims, 8 Drawing Figures

Fig. 2.
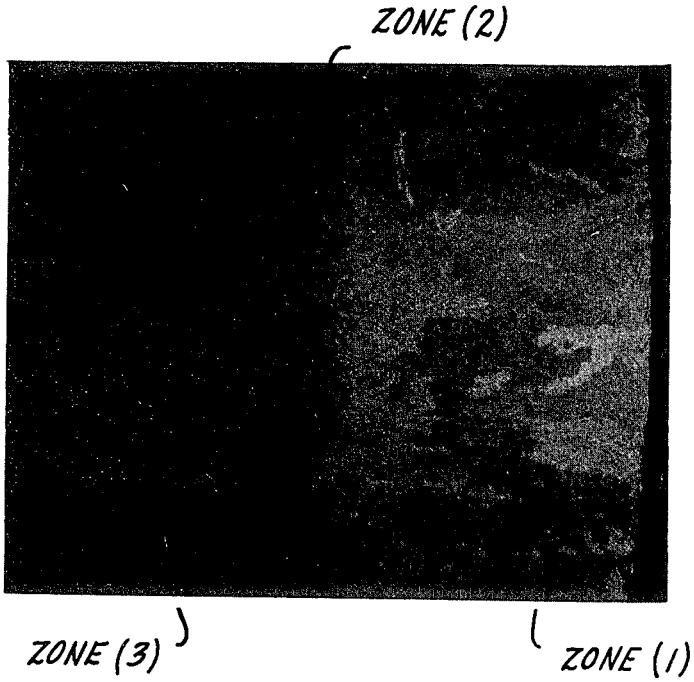
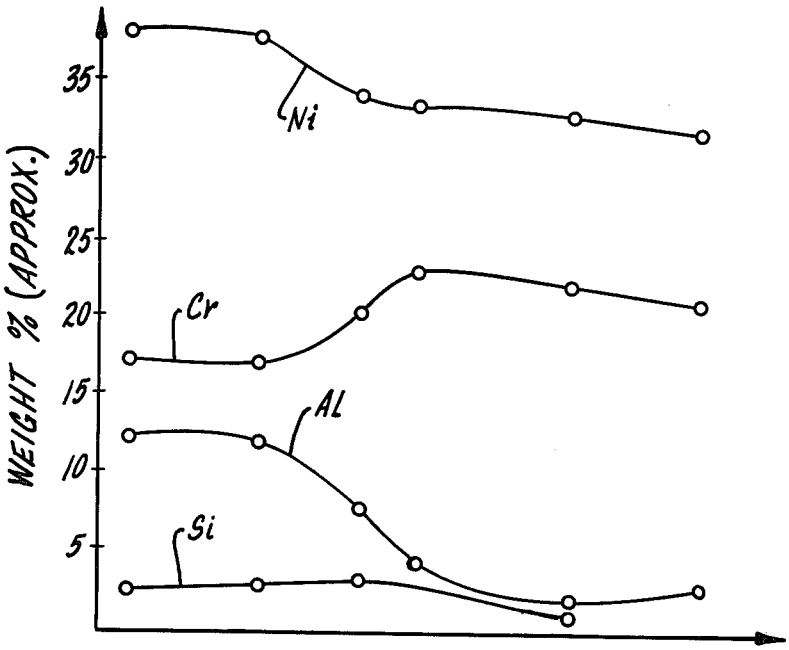
Fig. 2A.

CENTRIFUGAL CASTING

This is a division of application Ser. No. 168,728, filed July 14, 1980 and now abandoned.

This invention relates to centrifugal casting and in particular casting centrifugally alloys containing a substantial amount of a light, easily oxidized element, either as a pure metal or a light alloy itself.

Castings employed under oxidation, carburization or corrosion conditions at elevated temperatures are usually cast from an alloy containing a high percentage of chromium. In view of the price and the potential shortage of chromium as a strategic metal, the problems of chromium substitution, lower chromium content or increase of the service life of a chromium-containing alloy are of great importance. One of the main alternatives for chromium as an element providing oxidation-corrosion resistance is aluminum, but unfortunately high aluminum steels cast in air are generally unacceptable due to poor castability and the large amounts of dross and oxides present in the metal.

One of the objects of the present invention is to produce a centrifugally cast tube of a heat-resistant alloy high in aluminum content (especially at the ID surface) while nonetheless producing a casting free of objectionable dross and oxide inclusions.

Another object of the present invention is to be able to produce at will gradients of concentration of the oxidizable element in the cross section of the casting.

Another object of the invention in a broader sense is to cast an easily oxidized metal, or a metal containing an easily oxidized element centrifugally while precluding atmospheric oxygen.

In the drawing:

FIG. 2 is a photomicrograph (magnification 6X) of a cross section of a tube cast centrifugally in accordance with the present invention;

FIG. 2A is a graph in which the abscissa is substantially aligned to and shows the distribution of of elements across the radius of the casting of FIG. 2;

Figure 1:
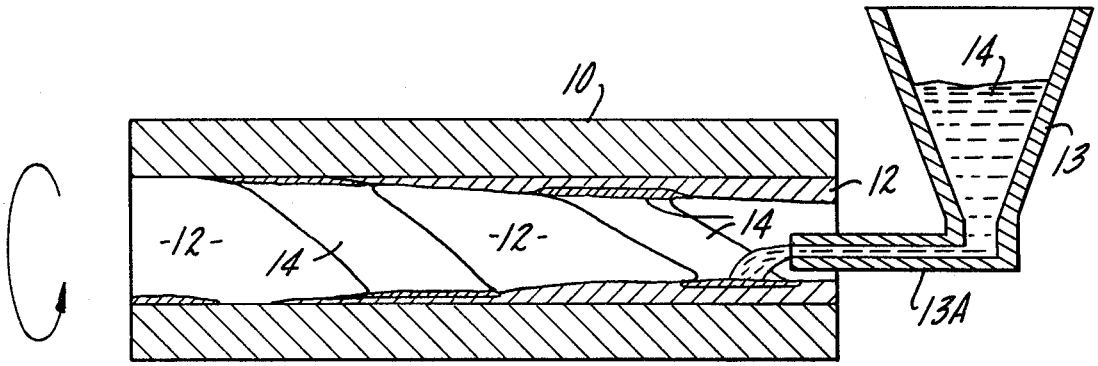
FIGS. 1, 1A and 1B are sectional views, partly schematic, of a centrifugal mold in several stages of producing a casting and wherein, for convenience, the ordinary end caps for the mold are omitted.
Figure 1A:
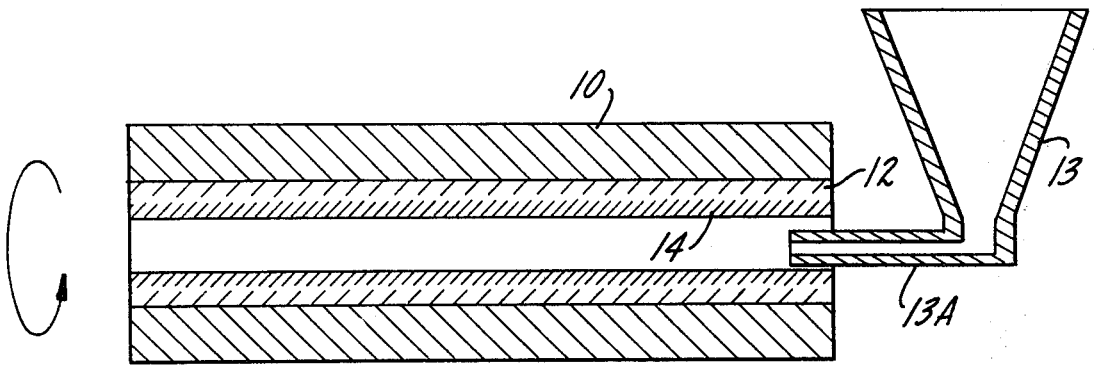

Typical centrifugal mold apparatus as shown in FIG. 1 comprising a centrifugal mold 10. The molten metal for the casting pours from the end of a spout 13A which is part of a pouring vessel 13. Because of the rotating mold the entrant metal, whatever its kind, spirals down the ID of the mold, as the molten metal will act like any other free body of liquid seeking its own level, especially with the force of the reservoir (vessel 13) behind it.

Earlier in the process, a light, low melting point metal 12 was deposited in the same way on the ID of the mold, having solidified, and as shown in FIG. 1 a heavier metal 14 having a much higher melting point is being deposited on the previous layer of lighter metal 12.

The first portions of heavier metal 14, therefore, will remelt outer layers of the lighter metal 12 and will spirally slip across the partially remelted substrate of the lighter metal like a skate on ice. The oncoming streams of the high melting point metal gradually remelt remaining light metal and the rest of the heavier metal eventually slips over the molten alloy containing both heavier and lighter metal. At these moments the lighter metal is dissolved only in the zone adjacent to the O.D. of the molten tube and, therefore, this zone is lighter than the rest of the metal. Because of centrifugal force, the heavier metal 14 will gravitate in the direction of the outside (OD) diameter of the centrifugal mold, or stated in other words, the lighter metal will be at the ID of the resultant cast tube T.

Figure 1B:
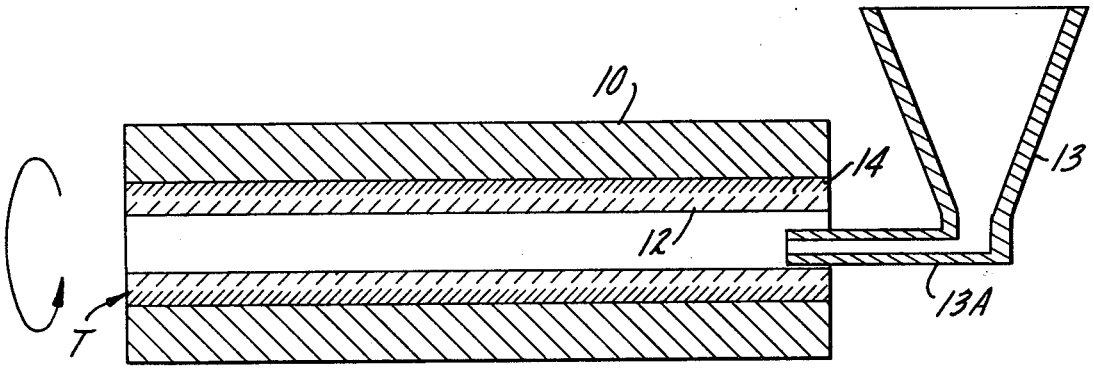

Essentially, there are four stages in principle although in actual practice they may by no means exhibit the distinctiveness shown in the drawing. The first stage is solidification of the light metal followed next by the occurrence of the heavier, high melting point spiralling across the earlier deposited light metal, FIG. 1. The taper shown for the lighter metal in FIG. 1 is actual, and is desirable in some cases for the achieving of a uniform ID alloyed layer, especially when a lower rotating speed of the mold is employed. In the third stage the melted metals attain uniform wall thickness with the heavier metal at the ID, but because the mold continues to rotate the heavier metal moves to the OD, FIG. 1B, where it remains while the casting cools to the solid state during the last stage.

More specifically, a No. 356 aluminum alloy (6.5 to 7.0% silicon) was poured at 1450° F. into the rotating mold which had been preheated to 400° F. Afterwards, a heat-resistant alloy (HRA alloy) of 35% nickel, 19% chromium, 0.42% carbon, 1.2% silicon and 1.2% manganese (balance iron except for impurities) was poured at 2900° F. onto the earlier formed, thin aluminum "tube" 12 from the same end of the mold.

The resultant centrifugally cast tube was found to contain three zones of metal:

(1) an ordinary HRA zone at the outside diameter (rich in HRA metal) with some residual Al (lean in Al) dissolved in it, (2) a transition zone, and (3) an aluminum-rich alloy zone at the inside diameter (lean in HRA metal), all zones being shown in FIGS. 2 and 3, as will be explained in more detail below.

Aluminum oxide clusters were observed only near the inside diameter (ID) surface of the tube, and in surprisingly small quantities for an air-melted heat containing so much aluminum.

Figure 3:
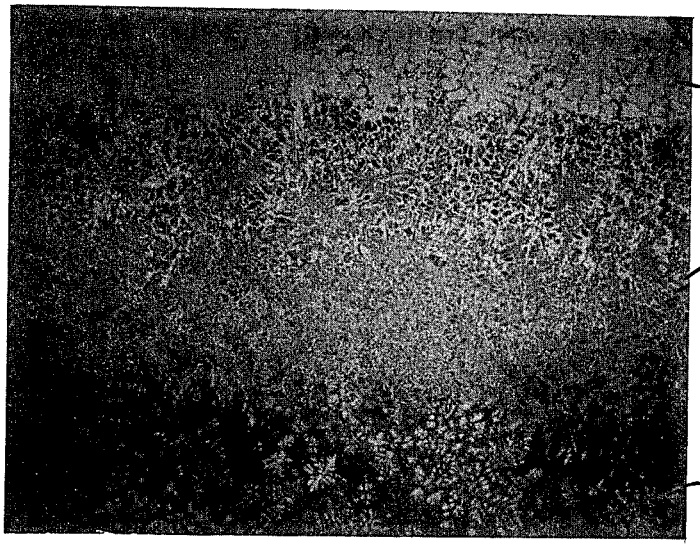
FIG. 3 is a photomicrograph of the casting of FIG. 2 at a magnification of 40X.

The three zones (1), (2), and (3) are designated in FIGS. 2 and 3. The OD for the most part is the HRA alloy identified above but containing evenly distributed aluminum nitrides while the aluminum-rich alloy at the ID contains Fe-Ni-Al with some chromium carbides precipitated in intermetallic phases precipitated in interdendritic areas.

Clearly, when the heavier metal 14, FIG. 1, was poured the standard HRA melt covered and remelted the aluminum alloy which was then shifted toward the inside diameter during continued rotation of the mold. However, some aluminum is dissolved in the HRA alloy during the shift, lowering the melting point of the alloy at the OD. The greater alloying with aluminum occurs at the ID, lowering the melting point of that alloy still further. The ID may be covered by an aluminum-rich oxide film providing protection against further oxidation. Those light oxide inclusions which get underneath the film do not propagate deeply into the metal owing to their light weight and the centrifugal force.

Because of the increase in aluminum content a tube cast centrifugally in the manner of the present invention will exhibit higher corrosion, oxidation and carburization resistance compared to the corresponding HRA alloy having no aluminum. Also, the aluminum-rich layer at the ID, having heavy precipitation of intermetallic phases and carbides will be harder and will exhibit improved abrasion resistance for those applications where hardness is a controlling factor. The hardness measured at the ID surface of several tubular products produced according to the present invention was up to 430 BHN.

In any event, the process of the present invention may permit reduction in chromium content relying on aluminum substitution, especially for those applications where high temperature corrosion and oxidation resistance are most needed.

The HRA alloy specified above is only one of a whole host to which the invention may be applied. A family of HRA alloys to which the present invention may be applied is given in U.S. Pat. No. 4,077,801:

| | | |
|---|---|---|
| Carbon | 0.25 to 0.8 | balance iron except for impurities and tramp elements |
| Nickel | 8 to 62 | |
| Chromium | 12 to 32 | |
| Silicon | Up to 3.5 | |
| Manganese | Up to 3 | |

Most aluminum alloys may be employed without difficulty, depending on the final composition of metal required. Additions of other easily oxidized elements, such as titanium or boron, can be placed into the metal 12 in the form of a coarse powder of their low melting temperature alloys.

When additions of surface active elements such as boron are employed the time of solidification of the casting is apparently reduced due to lowering of the surface tension between the solid state nuclei and liquid phase. As a consequence, less centrifugal separation was observed and almost uniform distribution of aluminum through the wall of the casting resulted.

The principles of the invention would be equally applicable when replacing the HRA alloy with any steel such as a stainless steel, any other HRA alloy, or a nickel or cobalt base alloy; indeed the replacement can be any alloy melting appreciably higher and which is appreciably heavier than the light weight alloy and which is advantaged or improved by having the light weight, low melting point metal move therethrough while both are in the molten state.

Preferably the mold will be preheated at 350° F.–400° F. to avoid premature solidification when the lower melting point metal is first introduced to the mold cavity. Since the mold in most instances will have a mold wash lining (e.g. one sixteenth of an inch thick) on the inside diameter derived from a mixture of silica and water, heating the mold to drive off the water will also afford all, if not the major part of the preheat.

For any given amount of lighter, low melting point metal initially poured the distribution of the lighter element through the cross section of the casting will be proportional to the following major influences:

(1) The rotational speed of the mold over the time period required for solidification to be attained because a higher speed means higher degree of centrifugal separation and more of the heavier metal moving radially outside; higher rotational speed will also result in higher longitudinal velocity of the heavier metal, so that less heat is lost during this period of the process and, therefore, more time is available for the centrifugal separation;

(2) The pouring temperature of the heavier metal, because when the metal is poured "hotter," the total time of solidification is increased and more centrifugal separation occurs; and because metal possesses higher fluidity at higher temperatures it will move more quickly in the longitudinal direction in the first moments of the process;

(3) The thickness of the mold wash, because it also influences the total time of metal solidification.

It will be recognized that alloying between the light and heavy metals takes place inside the mold. At all times the light metal, if easily oxidized, is prevented from doing so to any objectionable degree. The objectionable oxidation is that which ordinarily occurs when an HRA metal, combined with aluminum, is poured into the mold from a vessel as 13, at or above the melting point of the HRA-aluminum alloy. Objectionable oxidation does not occur when merely pouring the aluminum alloy at its melting point into a preheated mold, say when pouring at 1400° F. into a mold at 400° F. Now then, when the HRA metal 14, not yet alloyed with aluminum 12, is poured at say 2900° F., the aluminum, though melting on contact, FIG. 1, is covered by the molten HRA metal which induces the melting, and hence the easily oxidized metal is blanketed against oxidation. In comparison, an HRA-aluminum alloy of the proportion specified above, when poured all at once, will exhibit a drossy, porous, heavily oxidized ID which can be rendered acceptable only at an exorbitant machining cost to reduce the wall thickness to a radius of sound metal; the loss in yield is prohibitive in most instances.

A further advantage is the ability to pour the HRA metal 14 at a temperature lower than heretofore. Thus, the HRA metal or the high melting point metal is usually poured at a temperature considerably above the liquidus so it will not be solidfied too quickly by the much cooler mold. Such is not necessary under the present invention, especially when the lighter metal is aluminum because in that case the aluminum not only melts, becoming a "lubricant," it is dissolved in the HRA molten metal at the same time and heat of solution is generated, meaning the HRA metal need not be poured at the higher temperature to assure sustained fluidity.

The lower temperature results in a finer grain size which usually means (and in the case of HRA-aluminum does mean) a stronger casting.

Figure 4:
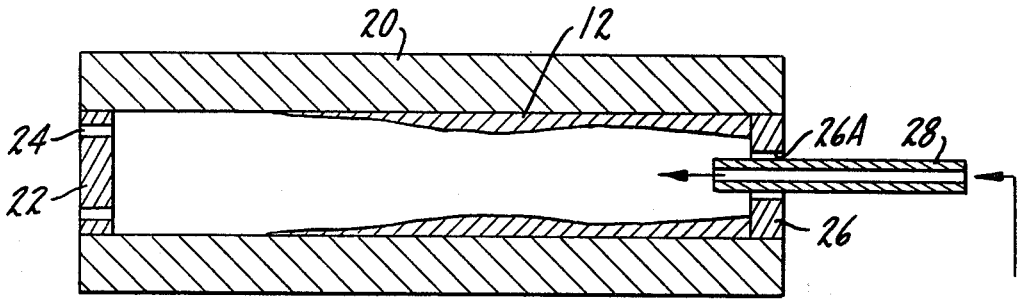
FIGS. 4 and 4A are views similar to FIG. 1 showing several stages of casting centrifugally under another embodiment of the invention.
Figure 4A:
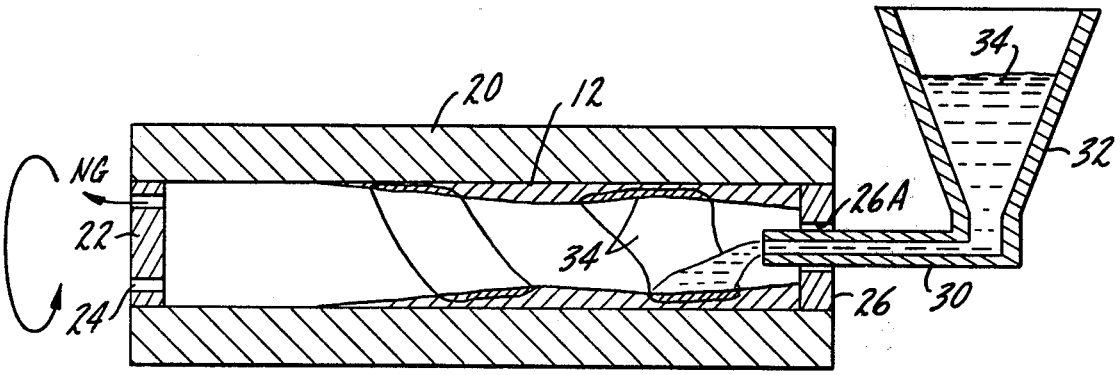

In accordance with the broader objective of the invention it is possible to reduce further the formation of nonmetallic inclusions and improve the surface quality of the castings even at the ID. This is made possible by displacing air from the mold, after the light metal has solidified, with a confined body of non-oxidizing gas which itself is afterwards displaced as an incident to casting the heavy metal or alloy. Thus, referring to FIG. 4, a centrifugal mold 20 is provided with the usual end caps, but in this instance one end cap 22 is provided with one or more vent openings 24 and the other end cap 26 has a central aperture 26A of a size to admit a lance 28 which feeds a non-oxidizing gas such as argon into the mold interior after the light metal has solidified. Argon displaces air out the vent hole, which is continued until the body of gas inside the mold is the non-oxidizing gas. The lance is withdrawn and the openings in the end caps are temporarily sealed with a displaceable plug or rupturable diaphragm (not shown) which may be nothing more than a piece of plastic film.

When the casting is to be completed, the pouring spout 30 of a pouring vessel 32 is positioned in aperture 26A incidental to allowing molten metal 34 (heavy metal) to pour onto the previously poured light alloy at the inside diameter of the mold, which is being rotated.

The molten metal expands the gas (NG) which is forced from the mold at the vent 24 and at the annular venting space presented by aperture 26A.

The non-oxidizing gas continues to be displaced as the molten metal spirals down the mold, seeking its own level as any other fluid body.

Since the mold was and remains air-free from the inception of pouring the heavier metal there can be no appreciable oxidation of the molten metal, nor formation of nonmetallic inclusions at the ID.

By heavy and light metal I mean, of course, a metal of high density and one of substantially lower density respectively, characteristic of an HRA alloy on one hand and aluminum on the other hand, for example. As can be seen by inspection in FIGS. 2 and 2A the casting in terms of the low density metal for example is characterized by low concentration near the O.D., substantially higher and in fact maximum concentration near the I.D., and in between its concentration is continuously increasing in the direction of the I.D. while that of the high density metal is decreasing.

I claim:

1. A centrifugal casting having at and near the outside surface a first zone having a high concentration of a dense metal alloyed with a low concentration of a less dense metal; a second zone having a higher concentration of the less dense metal, higher than in the first zone, alloyed with a lower concentration of the dense metal, lower than in the first zone, at and near the inside surface; and a transition zone between the other two zones where the concentration of the less dense metal is continuously increasing radially in the direction of the inside surface.

2. A centrifugal casting according to claim 1 of tubular form in which the less dense metal is principally aluminum and in which the dense metal consists essentially of:

| | | |
|---|---|---|
| carbon | 0.25 to 0.8 | balance iron except for impurities and tramp elements. |
| nickel | 8 to 62 | |
| chromium | 12 to 32 | |
| silicon | up to 3.5 | |
| manganese | up to 3 | |

3. A casting according to claim 1 achieved by pouring the less dense metal into a rotating centrifugal mold and allowing it to solidify while rotating the mold, and afterwards pouring the dense metal into the mold atop the less dense metal to melt it while rotating the mold until the melted less dense metal has attained the inside of the casting.

4. A tubular centrifugal casting having a low concentration of a less dense metal and a high concentration of a dense metal combined in a zone at and near the outside; having a lower concentration of the dense metal, compared to the outside zone, and a higher concentration of the less dense metal, also compared to the outside zone, combined in a zone near the inside of the casting; and having a transition zone between the other two zones where the less dense metal exhibits a continuously increasing concentration radially inward in the direction of the inside zone.

5. A centrifugal casting according to claim 4 in which the less dense metal is principally aluminum and in which the dense metal consists essentially of:

| | | |
|---|---|---|
| carbon | 0.25 to 0.8 | balance iron except for impurities and tramp elements. |
| nickel | 8 to 62 | |
| chromium | 12 to 32 | |
| silicon | up to 3.5 | |
| manganese | up to 3 | |

6. A centrifugal casting according to claim 4 or 5 achieved by pouring the less dense metal into a rotating centrifugal mold and allowing it to solidify while rotating the mold, and afterwards pouring the dense metal into the mold atop the less dense metal to melt it while rotating the mold until the melted less dense metal combined with the dense metal has attained the inside of the casting.

* * * * *